9/16/86 OR 4,612,269

United States Patent [19]

Westdale et al.

[11] Patent Number: 4,612,269

[45] Date of Patent: Sep. 16, 1986

[54] METHOD OF FABRICATING A LITHOGRAPHIC MASTER

[75] Inventors: Virgil W. Westdale, Barrington; James L. Hanrahan, Mt. Prospect, both of Ill.

[73] Assignee: AM International, Chicago, Ill.

[21] Appl. No.: 717,656

[22] Filed: Mar. 29, 1985

[51] Int. Cl.[4] ..... G03G 15/20

[52] U.S. Cl. ..... 430/49; 430/98; 430/106.6

[58] Field of Search ..... 430/49, 106.6, 122, 430/302, 98

[56] References Cited

U.S. PATENT DOCUMENTS 4,430,403 2/1984 Westdale et al. ..... 430/106.6

*Primary Examiner*—John L. Goodrow

*Attorney, Agent, or Firm*—Nicholas A. Camasto; Donald C. Kolasch

[57] ABSTRACT

A process of preparing a lithographic printing master is presented utilizing electrophotographic principles. As a result of the high density, low background images which can be developed using the disclosed novel developer composition, a high quality lithographic master can be fabricated. The novel developer comprises a low melt viscosity polyamide resin composition, a magnetic oxide component and a conductive carbon pigment.

9 Claims, 1 Drawing Figure

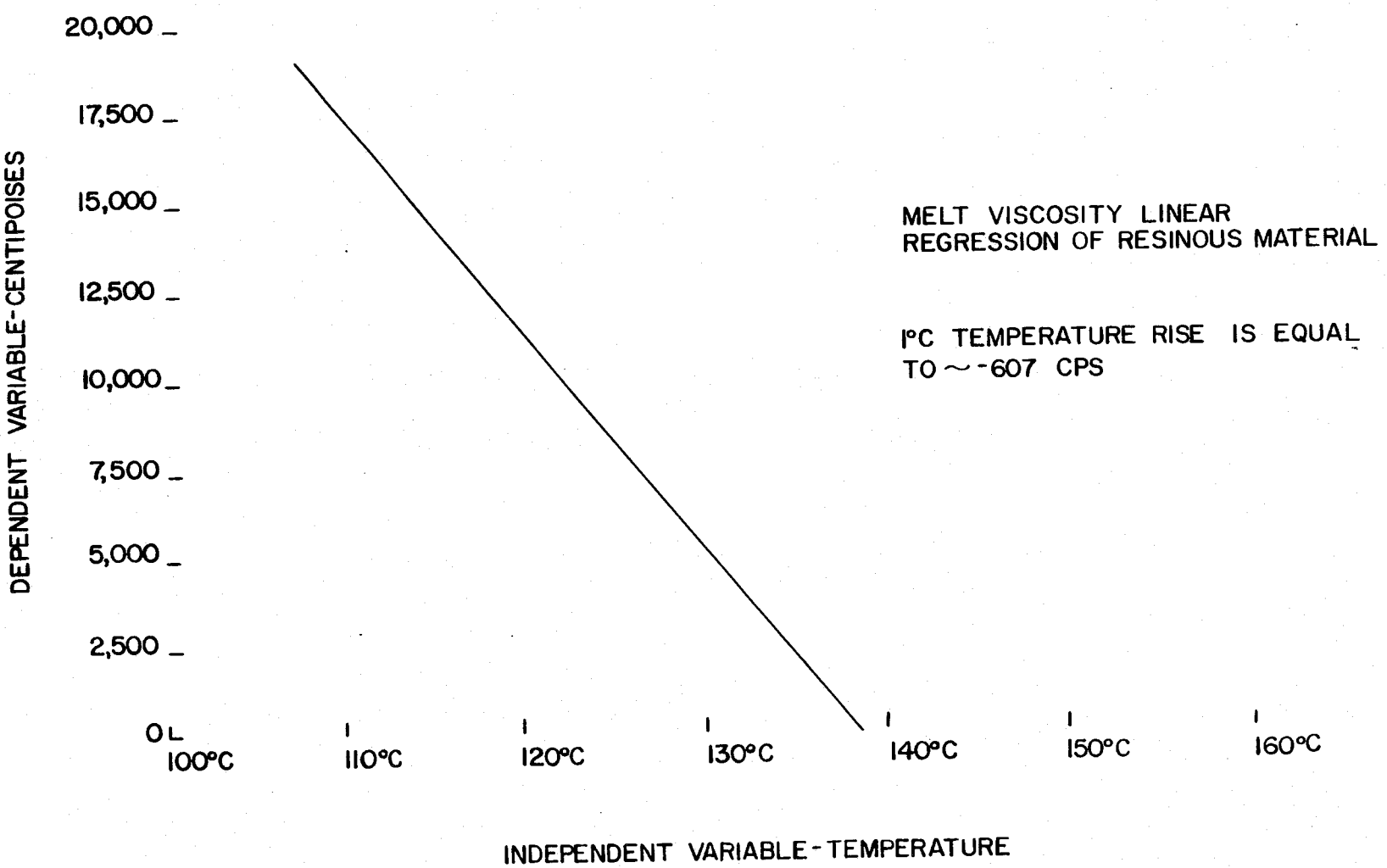
MELT VISCOSITY LINEAR
REGRESSION OF RESINOUS MATERIAL
1°C TEMPERATURE RISE IS EQUAL
TO ~ -607 CPS
20,000
17,500
15,000
12,500
10,000
7,500
5,000
2,500
0
100°C
110°C
120°C
130°C
140°C
150°C
160°C
DEPENDENT VARIABLE-CENTIPOISES
INDEPENDENT VARIABLE-TEMPERATURE

METHOD OF FABRICATING A LITHOGRAPHIC MASTER

BACKGROUND OF THE INVENTION

This invention relates to an imaging system and, more specifically, to lithography.

Lithographic printing is a well known and established art. In general, the process involves printing from a flat plate depending upon the difference in properties between image and non-image areas for printability. In conventional lighography, the non-image area is hydrophilic while the image is hydrophobic. A fountain solution is applied to the plate surface which wets all portions of the surface not covered by the hydrophobic image. This solution keeps the plate moist and prevents it from scumming up during the printing phase of the process. An oil-based printing ink is applied to the image surface, depositing the lithographic ink on the image area, the hydrophilic non-image area repelling the ink. The ink image may then be transferred directly to a paper sheet or other receptive surface, but generally it is transferred to a rubber offset blanket which, in turn, transfers the print to the final paper copy. Hence, for each print made during a run, the lithographic plate is dampened with an aqueous fountain solution, inked with a lithographic printing ink and printed via an offset blanket onto the final receptive copy sheet.

It has been known that lithographic plates can be made electrophotographically by utilizing conventionally developed electrophotographic plates as lithographic printing masters. In these systems, usually a zinc-oxide type of plate is charged by conventional means and exposed to the image to be reproduced with the resulting electrostatic latent image developed with conventional electrostatic toner. The toner is generally hydrophobic in nature, as is the undeveloped background area of a conventional binder-type electrophotographic plate. In order that the developed plate be useful as a lithographic master, a differential must be established between the toner image and the background of the plate. Since both are hydrophobic in nature, it is necessary to treat the background of the electrophotographic plate by the use of a conversion solution so as to render the background surface hydrophilic in nature. After the alteration of the non-image, background area, a nonaqueous, oil-based ink can be used whereby the toner will accept the ink and the now hydrophilic background areas will repel the ink.

While these systems have been found useful for lithographic purposes, there are inherent disadvantages in their use. For example, in the preparation of a printing master, it is necessary, in order to produce final printed images of lithographic quality, that the developed electrophotographic image be of extremely high-quality copy with sharp images of high-image density and minimal background so that the master produced can withstand the vigors of the lithographic process over extended periods of usage, a lithographic system inherently being a high-volume printing process. In the heretofore used developer systems in preparing electrophotographic printing plates to be utilized in lithographic printing processes, the images formed have been found to be less than adequate to produce the results required in lithography. Poor quality images have led to deficient masters which produce relatively short periods of usage time. In addition, high background and poor image density have contributed to the deficiencies.

It is, therefore, an object of this invention to provide a lithographic printing system which will overcome the above and other disadvantages.

It is a further object of the invention to provide a novel method for the preparation of a lithographic printing master.

Another object of the present invention is to provide an imaging system utilizing a novel lithographic master prepared from an electrophotographic plate.

Still a further object of the present invention is to provide a novel lithographic printing plate utilizing electrophotographic principles.

Yet, still a further object of the present invention is to provide a lithographic printing plate prepared by an electrophotographic system wherein the master produced is of a high-quality image with low background and high-image density and sharpness.

The foregoing objects and others are accomplished in accordance with the present invention, generally speaking, by providing a lithographic printing plate prepared electrophotographically wherein a single component developer composition, hereinafter referred to as a toner, for developing electrostatic latent images, is utilized comprising a resinous component having a sharp melt point and low melt viscosity essential for pressure fusing the exhibiting good cold-flow characteristics, inclusive of good wetting properties under pressure. For purposes of the present invention, the specific polyamide resin composition was determined to be highly suitable for use as a single component toner resinous component due to its sharp melting point characteristics and low melt viscosity. Included as a component of the polyamide toner composition is a magnetic oxide material, so that the final composition comprises 35–50 percent resin composition to 65–50 percent magnetic oxide. Below 35 percent resin, the adhesiveness of the toner will begin to deteriorate. In a preferred embodiment of the present invention, the particle size of the developer will range from a 10 micron absolute minimum to a 40 micron maximum resulting in less background, lower light exposure settings, better powder flow characteristics, less toner dust in the image development area and less tendency for the particles to spray over defined image edges, particularly around large solid areas.

The resulting polyamide-magnetic oxide toner composition possesses excellent cold-flow characteristics under pressure to exhibit unexpected pressure fixing characteristics. Since the subject resins have good cold-flow characteristics, they inherently possess the capability to desirably wet-out the magnetic oxide particles in the formulation. This wetting-out characteristic and relatively good cold-flow property of the toner is also attributed to the presence of the specific amount of magnetic oxide since the magnetic oxide has good dispersing characteristics and plays an important role in the cold-flow mechanism. The developer toner further preferably includes a highly conductive carbon pigment to regulate the resistivity of the resulting toner particle.

It has been determined in the course of the present invention that lithographic printing masters may be fabricated electrophotographically so as to produce a master having an extremely sharp image with minimal background utilizing a single component developer composition or toner comprising a pigmented polyamide resin and a magnetic oxide component to develop the electrostatic latent image. The instant developer composition exhibits the necessary characteristics which permit the toner to be used in an electrophotographic imaging process.

The utilization of the polyamide resin of the present invention will permit the formulation of a single component toner with a magnetic oxide content ranging from 50 to 65 percent by weight. The pressure fusible toners of the present invention are especially suitable for fabricating lithographic masters herein defined which are subsequently used for duplicating. The polyamide resins used in the process of preparing the printing master of the present invention provide for the required sharp melting point and low melt viscosity and corresponding necessary cold-flow characteristics, when used in combination with the magnetic oxide additive in the percentages prescribed, to provide an effective lithographic printing master.

BRIEF DESCRIPTION OF THE DRAWING

FIG. 1 represents a graphic representation of the melt viscosity linear regression of the resinous component of the developer of the present invention.

DETAILED DESCRIPTION OF THE INVENTION

The developer composition of the present invention with its pressure fixing properties is particularly suitable in preparing printing masters electrophotographically. Utilizing a photoconductive substrate of the coated variety, such as zinc oxide paper, an electrostatic image formed by conventional techniques is developed and pressure fused to the substrate which is used as a duplicating master in a lithographic printing mode.

In accordance with the present invention, a developer powder or toner is provided comprising at least 50 percent magnetic oxide and the balance a polyamide resin composition including an amide resin having a sharp melting point within the range of about 70° to 165° C., preferably within the range of from about 97° to 107° C., with a low melt viscosity. As used herein, the term polyamide resin refers to the polymerization product resulting from the condensation of polyamines with polybasic acids. The polyamide resin composition utilized is a specific blend of a low melt viscosity polyamide resin having a melting point within the above-stated range of from 70° to 165° C. and a polyamide-rosin blend in an amount of from about 25–35 percent of the amide-rosin blend and 76–65 percent of the polyamide resin. The polyamide-rosin blend is commercially available from Lawter International, Inc. This specific composition exhibits the desired properties to produce a pressure fixable toner.

A highly conductive carbon pigment is added to the developer powder or toner in order to provide the particles with a surface coating which will render them somewhat conductive, so as to decrease the resistivity of the particle, and enhance powder flow processing. Other pigment materials may be used in combination with the conductive carbon pigment in order to produce various desired effects. The carbon particles will generally have a size ranging from 12.0 to 22.0 millimicrons and will be added to the toner composition in an amount from about 0.5 to 4.0 percent, preferably 0.75 to 1.2 percent by weight base on the total weight of the toner. The conductive carbon is added to the toner or developer composition to impart thereto a resistivity ranging from 150 ohm/cm to $3\times10^5$ ohm/cm, and preferably $3\times10^2$ ohm/cm to $3\times10^3$ ohm/cm, to achieve the desired conductivity. Typical highly conductive carbon particles suitable for use in the present invention include Columbian CC-40-220 commercially available from the Columbian Chemicals Co., Vulcan XC-72R commercially available from Cabot Corp. and Corax L commercially available from the Degussa Corp. The resulting developer composition is classified to eliminate excess carbon.

Any suitable magnetic oxide component may be added to the resinous toner composition which imparts the desired effect to the single-component developer of the present invention. Typical magnetic oxide materials include $Fe_2O_3$, $Fe_3O_4$, and various forms of magnetite. The magnetic oxide component is present in the toner composition in an amount ranging from about 50 to 65 percent by weight, and preferably from about 55 to 60 percent, in order to achieve effective development and wetting properties. In such formulations the amount of polyamide resin present will range from about 50 to 35 percent by weight, and preferably 45 to 40 percent.

The resulting developer or toner particles of the present invention will comprise preferably a 10 micron absolute minimum to a 40 micron maximum resulting in less background, lower light exposure settings, better powder flow characteristics, less toner dust in the image development area and less tendency for the particles to spray over defined image edges, particularly around large solid areas.

Any suitable technique may be used in order to prepare the developer composition ot toner of the present invention. The polyamide resin may be mixed thoroughly with the magnetic oxide additive which have been previously reduced to the desired particle size. The resulting mixture is heated to about 180° to 200° C. to melt the polyamide resin and form a homogeneous melt which is blended and then allowed to cool and harden. At this point, the magnetic substance has been distributed thoroughly and uniformly throughout the resin composition. The cold, hardened mix is then broken up and ground to reduce the material to a particle size preferably 10 to 40 microns. The presence of the conductive carbon pigment decreases the resistivity of the resulting toner particles, thus substantially enhancing the performance of the single component toner system.

As seen from FIG. 1, the melt viscosity of the polyamide resinous composition of the present invention, as expressed in centipoises (cps), is unexpectedly low in relationship to temperature, and drops off sharply with increased temperature. A 1° C. temperature rise is equal to approximately a negative 607 cps. The resinous components of the conventional toner compositions have a much higher melt viscosity at the corresponding temperatures of the illustration such that they require the application of heat from an external source to realize the necessary flow properties to successfully fuse the toner. The resinous component of the present invention presents good wetting properties at low temperatures, thus providing for fusing of the toner upon application of pressure alone.

Any suitable material may be used as the substrate for the lithographic master of the present invention, with the specific developer composition with its unique pressure fixing properties being particularly suited for use with a coated substrate such as a zinc oxide binder plate, wherein a conversion solution will be utilized so as to establish the necessary hydrophilic properties with respect to the background non-image areas to provide the necessary property differential between the image and non-image areas for the application of the oleophilic lithographic printing ink. Typical substrate materials include zinc oxide binder plates and organic photoconductive binder plates, such as phthalocyanine photoconductors.

PREFERRED EMBODIMENTS

To further define the specifics of the present invention, the following examples are intended to illustrate and not limit the particulars of the present invention. Parts and percentages are by weight unless otherwise indicated. The examples are intended to illustrate various preferred embodiments of the present invention.

EXAMPLE I

A toner consisting of 500 parts of a polyamide resin comprising 10 parts of a P-1084 polyamide resin-rosin and 25 parts of a P-4771 polyamide resin, both available from Lawter International, Inc., and a blend of 115 parts of $Fe_3O_4$ (magnetic oxide MO-8029 commercially available from Pfizer, Inc.) and 385 parts of $Fe_3O_4$ (magnetic oxide MPB Standard D commercially available from Indiana General) is prepared according to conventional melt blend techniques and the resulting particles size-classified to obtain a toner having a volume average particle size of from 10 to 40 microns. Conductive carbon pigment is added to the toner up to about 1 percent to enhance the powder flow properties.

An electrostatic latent image is formed on the surface of a zinc oxide master substrate, by conventional electrophotographic techniques and developed using the above toner. The developed image is fixed to the substrate by applying a pressure of 100 lbs./linear inch between steel rolls. The master plate is then wrapped on the cylinder of a lithographic printing press and operated in the conventional manner, first applying a conversion solution to alter the properties of the background non-image areas, followed by the application of a fountain solution using an ELFO desensitizer and acidic gum solution available from Azoplate Corporation. A lithographic ink is then applied to the printing surface of the plate and the ink image transferred in an image-wise configuration to a paper copy sheet via an offset blanket. High quality images are obtained.

EXAMPLE II

The process of Example I is repeated with the exception that 450 parts of the polyamide resin blend is mixed with 550 parts of the magnetic oxide ($Fe_3O_4$) blend (125 parts of the MO-8029 and 425 parts MPB, Standard D). The developer particles are classified to a particle size of from 12 to 35 microns. The developed toner image is pressure fixed to the coated photoconductive master and used in a lithographic printing press to produce high quality images.

The developer material of the present invention with its pressure fixing properties is particularly suitable for use in combination with photoconductive members of the coated variety, such as zinc oxide paper, and the electrostatic image formed by conventional techniques is developed and the toner image pressure fused to the substrate.

Although the present examples are specific in terms of conditions and materials used, any of the above typical materials may be substituted where suitable in the examples with similar results.

The invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed:

1. A process of preparing a lithographic printing master which comprises:

forming an electrostatic latent image on the surface of an electrophotographic lithographic member;

developing said latent image with a developer composition consisting essentially of a polyamide resin consisting of from 65–75 percent of a low melt viscosity polyamide resin having a melting point within the range of from about 70° to 165° C. and from 35–25 percent of a polyamide-rosin component, and a magnetic oxide in an amount ranging from 35–50 parts resin composition to 65–60 parts of said magnetic oxide, said developer material having the capacity to develop an electrostatic latent image which is pressure fixable; and pressure fixing said developed image to said member.

2. The process of claim 1, wherein said developer material comprises 50 parts of said polyamide resin composition per 50 parts of said magnetic oxide.

3. The process of claim 1, wherein said magnetic oxide comprises magnetite.

4. The process of claim 1, wherein said developer further includes a conductive carbon pigment in an amount ranging from 0.5 to 4 percent.

5. The lithographic printing master prepared according to the process of claim 1.

6. A method of making multiple copies from a lithographic printing plate which comprises applying to the surface of said lithographic printing plate of claim 5 a lithographic ink, said ink being distributed thereon conforming to said developed image in an image-wise configuration, contacting said inked surface with a copy sheet to thereby effect the transfer of an image to said copy sheet and repeating the inking and printing steps at least more than one time.

7. The process of claim 1, wherein said developer material ranges in particle size of from 10 to 40 microns.

8. The lithographic printing master prepared according to the process of claim 7.

9. The process of claim 1, further including the step of transferring said developer composition in an image-wise configuration from the surface of said electrophotographic member to a secondary lithographic substrate prior to the pressure fixing of said developed image thereon.

* * * * *